US006202252B1

(12) United States Patent
Harrisson

(10) Patent No.: US 6,202,252 B1
(45) Date of Patent: Mar. 20, 2001

(54) DOCTORING APPARATUS

(75) Inventor: Francois Harrisson, Fabreville (CA)

(73) Assignee: Valmet Ltd., Ville Saint Laurent (CA)

( * ) Notice: Subject to any disclaimer, the term of this patent is extended or adjusted under 35 U.S.C. 154(b) by 0 days.

(21) Appl. No.: 09/324,718

(22) Filed: Jun. 3, 1999

(51) Int. Cl.[7] ..... B31F 1/14; D12G 3/00
(52) U.S. Cl. ..... 15/256.51; 101/169; 162/281
(58) Field of Search ..... 15/256.5, 256.51; 101/159, 169, 365; 118/126, 261, 413; 162/281

(56) References Cited

U.S. PATENT DOCUMENTS

| | | | | |
|---|---|---|---|---|
| 4,367,120 | | 1/1983 | Hendrikz . | |
| 4,665,859 | | 5/1987 | Dunlap et al. . | |
| 4,906,335 | | 3/1990 | Goodnow et al. . | |
| 5,178,731 | | 1/1993 | Kivimaa et al. . | |
| 5,269,846 | | 12/1993 | Eskelinen et al. . | |
| 5,279,710 | * | 1/1994 | Aikawa | 15/256.51 |
| 5,417,761 | | 5/1995 | Bernert . | |
| 5,980,692 | * | 11/1999 | Goodnow et al. | 15/256.51 |

FOREIGN PATENT DOCUMENTS 2043842 6/1995 (CA) .

* cited by examiner

*Primary Examiner*—Terrence R. Till

(57) ABSTRACT

There is disclosed a doctoring apparatus for doctoring a cylindrical rotating surface of a machine. The doctoring apparatus includes a blade carrier assembly for holding a blade for doctoring a cylindrical surface. The blade carrier assembly further includes at least one movable tenon. The blade carrier assembly slides across a supporting surface of a doctor back. The doctor back includes a mortise which is sized to loosely receive the tenon to permit the tenon to slide within the mortise as the remainder of the blade carrier assembly slides over the supporting surface of the doctor back. Once the blade carrier assembly is located in a position relative to the doctor back, an adjustment mechanism carried by the blade carrier moves the tenon into locking engagement with the mortise. This adjustment mechanism is a releasable securing mechanism which allows the tenon to move in and out of locking engagement. This novel coupling arrangement allows for the entire blade assembly including the blade to be removed from the doctoring apparatus for maintenance purposes without having to perform maintenance operations within the machine.

8 Claims, 5 Drawing Sheets

DOCTORING APPARATUS

FIELD OF THE INVENTION

The present invention relates to a doctoring apparatus of the type employed in the processing of paper, textiles and other industrial products.

BACKGROUND OF THE INVENTION

In known doctoring apparatus, a doctor blade has a working edge that is applied to a rotating surface of an elongated cylinder. The working edge of the doctor blade removes materials from the rotating surface of the cylinder. The doctored materials to be removed may consist of a sheet or web being processed in a papermaking machine, or the doctored material may consist of contaminates accumulating on the surface of the cylinder.

Doctoring apparatus typically comprise a blade carrier assembly which is adapted to hold the doctor blade in operative engagement with the surface of the rotating cylinder to be doctored. The blade carrier assembly is mounted about a pivoting axis where the angle of the blade and pressure associated with the blade contacting the surface is controlled by two flexible walled tubes located on either side of the pivoting axis. The blade carrier assembly is mounted directly to a doctor back and the doctor back is positioned within the papermaking machine across the width of the cylindrical surface to be doctored. In some instances, the doctoring apparatus extends from 3 to 8 meters in width across a cylindrical roll.

The doctor blade is removably mounted in the blade carrier assembly. This permits the removal of the doctor blade for cleaning. However, maintenance of the blade carrier assembly is not as simple because it is not possible to remove the blade carrier assembly from the doctor back. Thus maintenance of the blade carrier assembly requires having to maintain the blade carrier assembly from within the machine which is difficult and cumbersome.

SUMMARY OF THE INVENTION

It is therefore an object of the present invention to provide a doctoring apparatus where the blade carrier assembly is removable from the doctor back to permit for easier maintenance of the doctor blade assembly.

The present invention relates to a doctoring apparatus for doctoring a cylindrical rotating surface. The doctoring apparatus has a doctor blade for doctoring the cylindrical surface. The doctor blade is carried by a blade carrier assembly that holds the doctor blade. The blade carrier assembly further has at least one moveable tenon suspended from the assembly. The apparatus further includes a doctor back having a supporting surface over which the blade carrier assembly is adapted to slide. The supporting surface has at least one mortise. The mortise is sized to loosely receive the tenon to permit the tenon to slide along the mortise as the blade carrier assembly is slid over the supporting surface so as to couple the blade carrier assembly with the doctor back. The doctoring apparatus has an adjustment mechanism which is carried by the blade carrier for moving the tenon into a locking engagement with the mortise so as to releasably secure the blade carrier assembly to the doctor back. Thus, the present invention provides the novel aspect of allowing the blade carrier assembly to slide relative to the doctor back and for the adjustment mechanism to lock the blade carrier assembly relative to the doctor back.

In the preferred aspect of the present invention, the tenon is carried by the blade carrier assembly and the mortise is carried by the doctor back. It is within the realm of the present invention to have the tenon carried by the doctor back and the mortise located in the blade carrier assembly.

Preferably, one mortise extends laterally across the doctor along a longitudinal axis that is parallel to the axis of the cylindrical rotating surface. This structure allows the blade carrier assembly to be slid across the doctor back and located in place. Alternatively, more than one such mortise and tenon combination can be located on each of the respective doctor back and blade carrier assembly. Also, the mortise may be located extending in from the sidewall of the doctor back and not necessarily extending completely across the width of the doctor back. It is envisaged that the mortise can extend in the doctor back orthogonally of the axis of rotation of the cylindrical surface. Further, the tenon preferably comprises one bar suspended from the blade carrier assembly and alternatively may comprise a series of spaced apart blocks in the shape of a tenon suspended in spaced apart locations along the blade carrier assembly.

In the preferred construction, the blade carrier assembly includes outer and inner spaced apart plates that are adapted to support the doctor blade. The inner plate is adapted to slide over the supporting surface of the doctor back and at least one tenon is supported from the inner plate. The adjustment mechanism is carried by the blade carrier assembly and includes at least one bracket having a bearing secured to the inner plate. A pivoting rod is secured to the outer plate and is journalled in the bearing of the bracket. A pair of flexible walled tubes are positioned between the spaced apart plates on either side of the bracket to form part of the adjustment mechanism. The tubes, once pressurized, further separate the plates to adjust the relative position of the doctor blade with respect to the cylindrical rotating surface. In so doing, the bracket is pulled away from the supporting surface to cause local deflection of the lower plate away from the doctor back. This results in the tenon moving into a locking engagement with the mortise.

In accordance with an aspect of the present invention there is provided a doctoring apparatus for doctoring a cylindrical rotating surface. The apparatus comprises a doctor blade for doctoring the cylindrical surface and a blade carrier assembly for holding the doctor blade. The blade carrier assembly includes one of at least one moveable tenon and at least one mortise. The apparatus further comprises a doctor back having a supporting surface to which the blade carrier assembly is adapted to be mounted. The supporting surface includes one of the other of the at least moveable tenon and the at least one mortise. The at least one mortise is sized to loosely receive the tenon to permit the tenon to slide into the mortise as the blade carrier assembly mounted onto the supporting surface so as to couple the blade carrier assembly with the doctor back. The apparatus further includes an adjustment mechanism carried by a selected one of the doctor back and blade carrier assembly for moving the tenon into locking engagement with the mortise to releasably secure the blade carrier assembly to the doctor back.

BRIEF DESCRIPTION OF THE DRAWINGS

The invention will be better understood and its advantages will become more apparent to those skilled in the art by reference to the following drawings, in conjunction with the accompanying specification, in which.

DETAILED DESCRIPTION OF EMBODIMENTS

Figure 1:
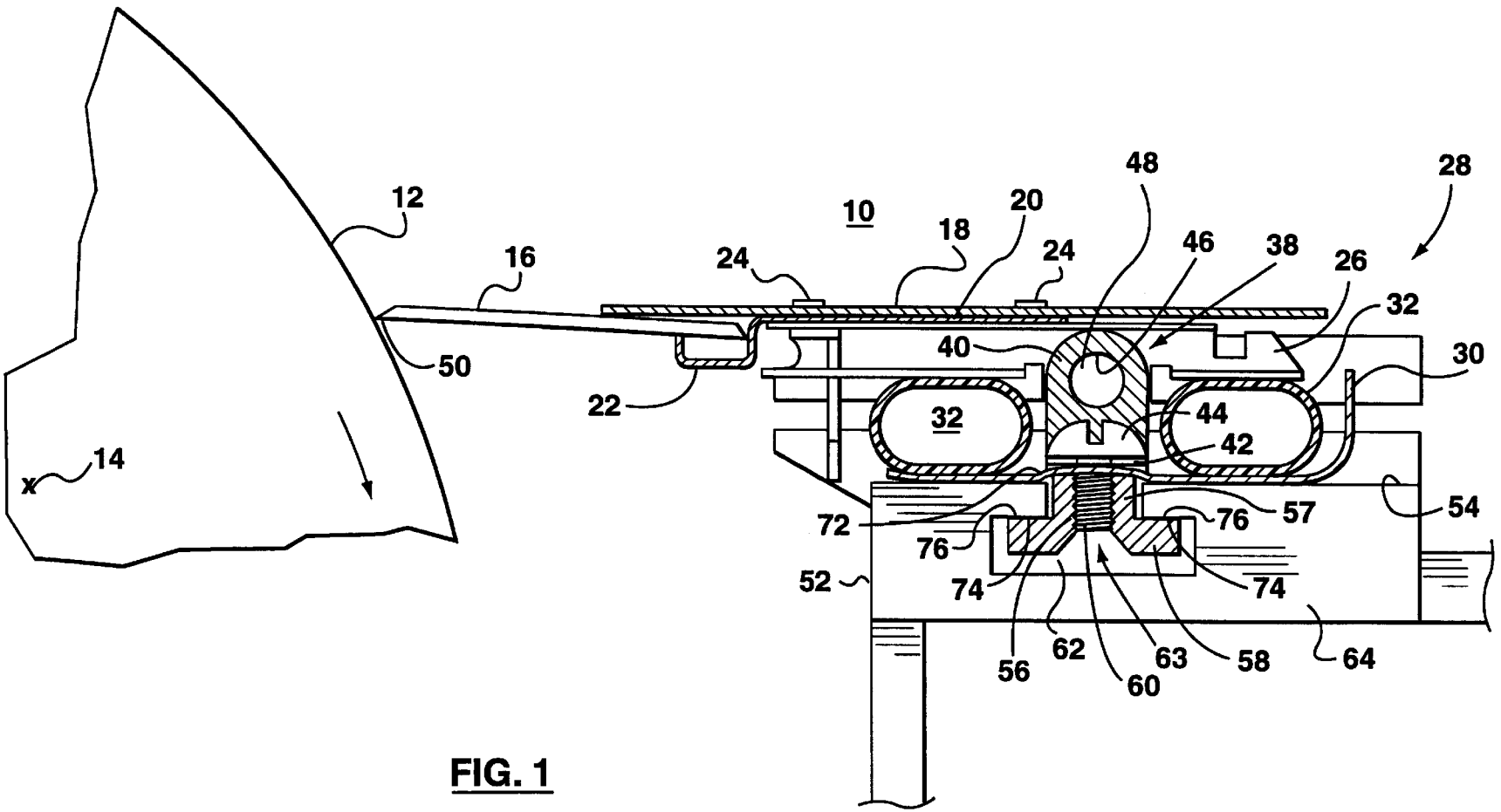
FIG. 1 is a side elevational view of the doctoring apparatus of the present invention in an operative locked position.

Referring to FIG. 1 there is shown the doctoring apparatus 10 of the present invention used for doctoring a cylindrical rotating surface 12 rotating about axis 14. The cylindrical rotating surface 12 may comprise a roll in a papermaking machine from which a web or contaminates are doctored from the surface.

In FIG. 1, the doctoring apparatus 10 is shown in an operative locked engagement position for doctoring the surface 12.

Figure 2:
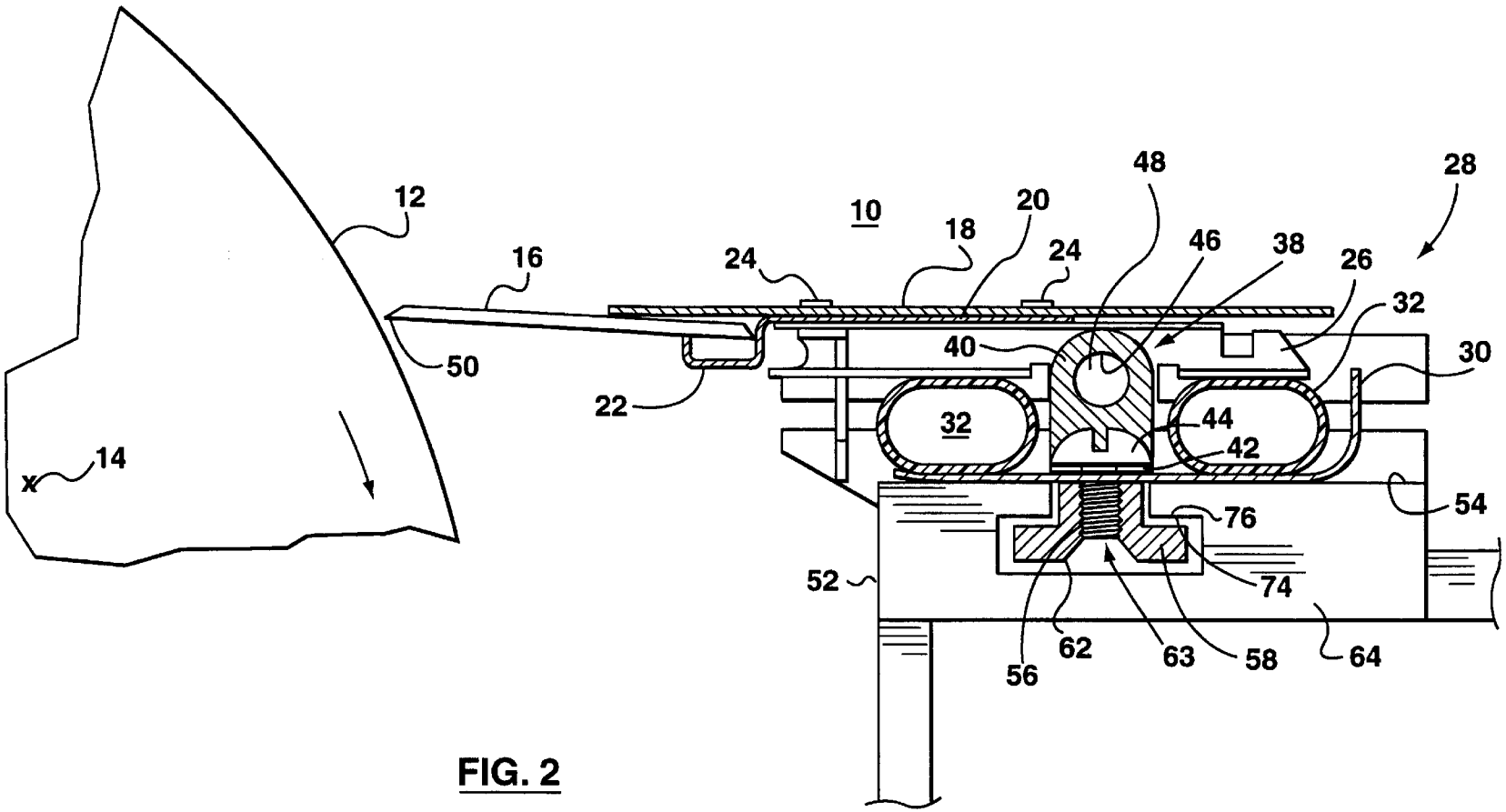
FIG. 2 is a side elevational view of the doctoring apparatus of the present invention in an un-locked position.

In FIG. 2, the doctoring apparatus 10 is shown in a coupled, unlocked position which not operable for doctoring of the cylindrical surface 12.

Referring to FIGS. 1 to 4, the doctoring apparatus 10 includes a doctor blade 16 mounted to a blade carrier assembly 28 between an upper plate 18 and an intermediate plate 20. Plate 20 includes jaw 22 into which an edge of blade 16 is inserted. The plates 18 and 20 are mounted by screws 24 to an outer support plate 26 of the blade carrier assembly 28. The outer plate 26 preferably extends across the width of the doctoring apparatus 10. Alternatively, a series of finger-like spaced apart outer plates 26 may be utilized.

The blade carrier assembly 28 further includes an inner, lower or base support plate 30. The lower plate 30 is separated from the outer plate 26 by flexible walled tubes 32. The flexible walled tubes 32 comprise a rubber or neoprene type material. The ends of the tubes are interconnected through nuts 34 (see FIG. 4) to supply hoses 36. Air pressure is forced into the tubes 32 so as to control the relative positioning of the tubes 32 and the position of outer plate 26 relative to lower plate 30.

Outer support plate 26 pivots relative to the lower plate 30 by an adjustment mechanism 38 further carried by the blade carrier assembly 28. The adjustment mechanism 38 includes a series of brackets 40 located along the blade carrier assembly 28. The brackets 40 have lower flanges 42 mounted to the lower plate 30 by screws 44 passing through flanges 42 and lower plate 30. The brackets 40 include a bearing surface 46 adapted for receiving journalled therein a pivoting shaft 48. Shaft 48 is mounted from the outer plate 26.

The relative positioning of the outer support plate 26 to the lower base plate 30 is controlled through the pressurization of the flexible walled tubes 32. This causes the outer plate 26 to pivot about the shaft 48 relative to the lower base plate 30 to control the engagement of the working edge 50 of the blade 16 against surface 12.

The blade carrier assembly 28 rests through the lower base plate 30 on doctor back 52. Doctor back 52 includes a supporting surface 54 over which the blade carrier assembly 28 and in particular the lower plate 30 slides laterally across to bring the working edge 50 of the blade 16 into close proximity with the cylindrical rotating surface 12.

Figure 3:
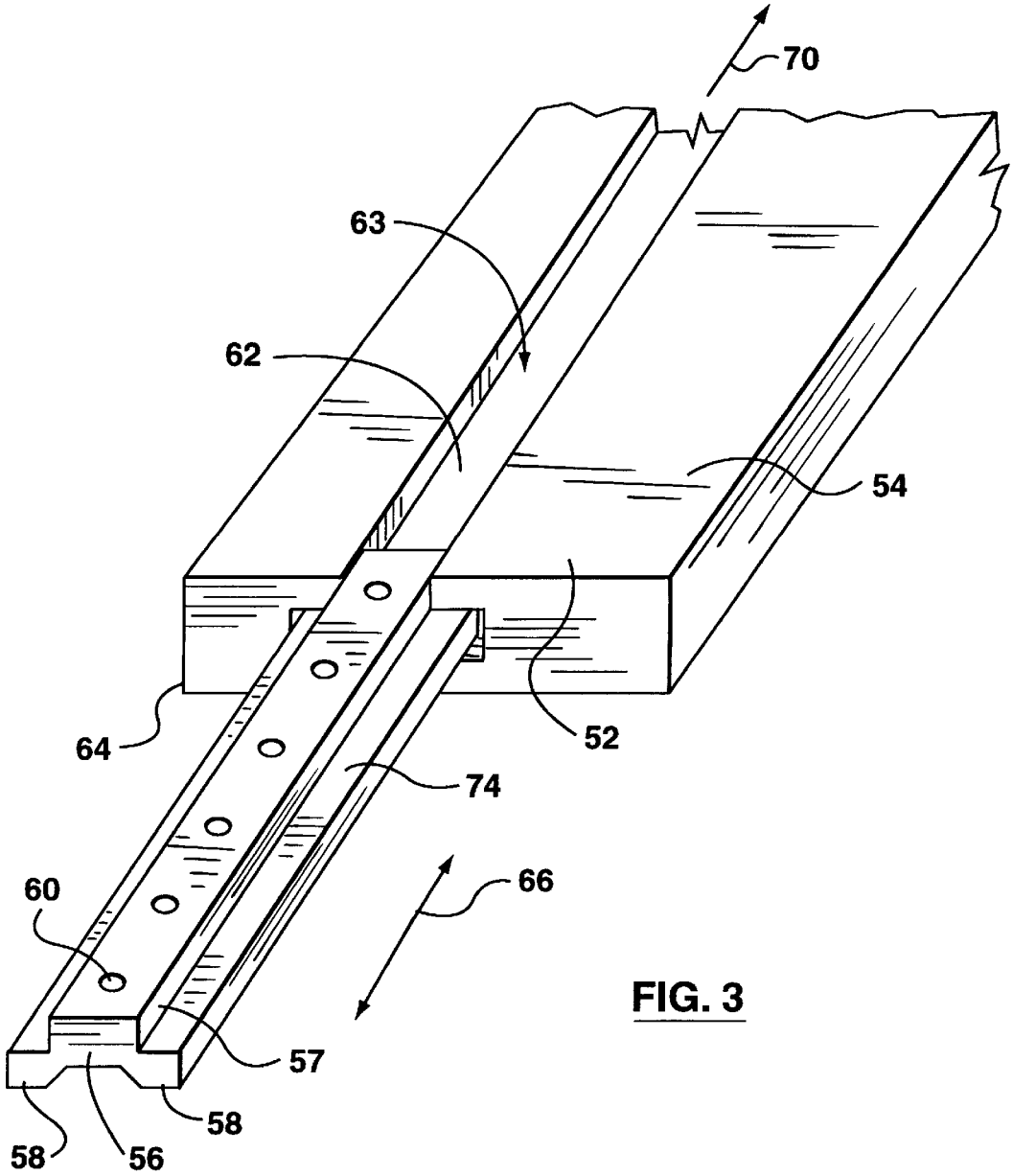
FIG. 3 is a representation showing the lateral movement of the tenon of the blade carrier relative to the mortise in the doctor back.
Figure 4:
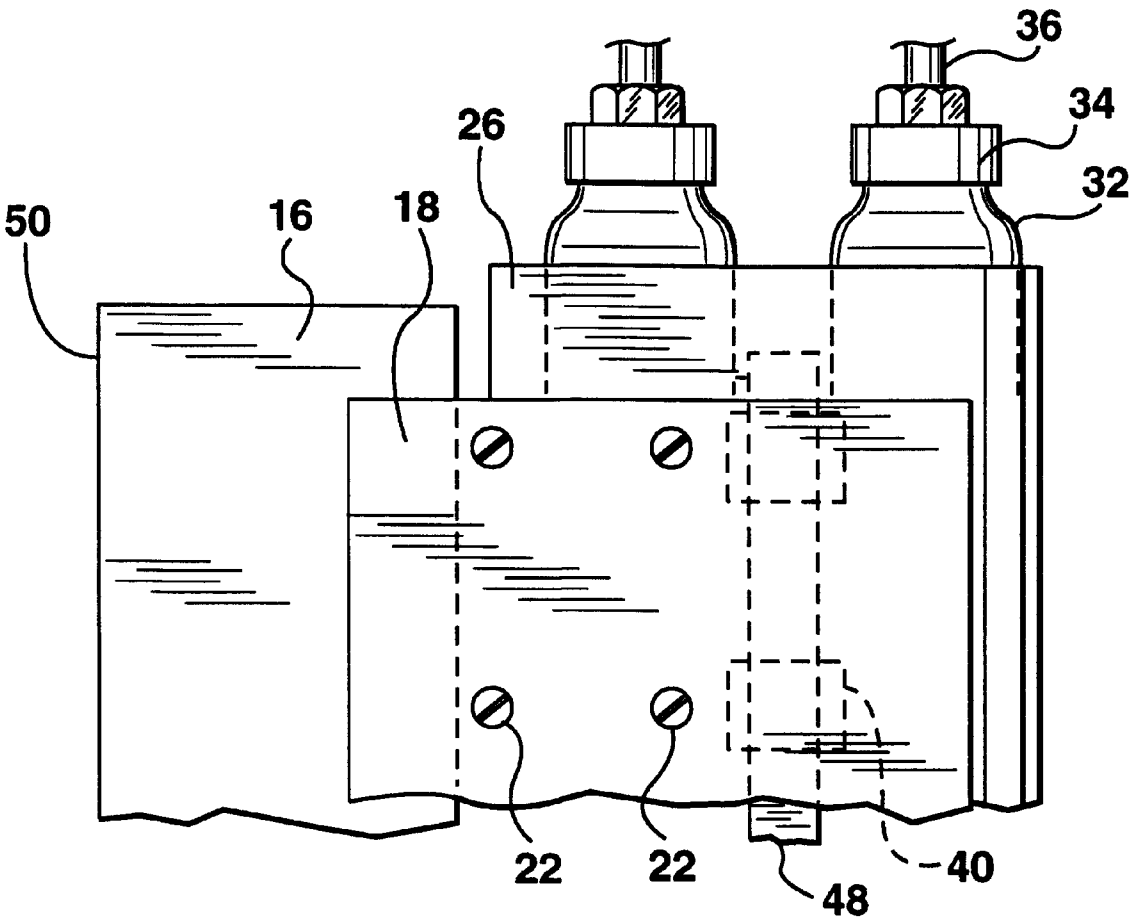
FIG. 4 is a partial plan view of the doctoring apparatus of the present invention; and, FIG. 5 is a side elevational view of the doctoring apparatus of the present invention illustrating an alternative embodiment.

In accordance with the present invention, the blade carrier assembly 28 further includes a tenon 56. The tenon 56 comprises an elongate bar as shown in FIG. 3 which has a stem 57 and two legs 58. The tenon has a generally inverted T-shape. The tenon 56 includes a series of apertures 60 through which the screws 48 are threaded so as to suspend the bar or tenon 56 from the lower base plate 30 of the blade carrier assembly 28. The tenon 56 is connected to lower base plate 30 prior to the insertion of the tenon 56 within the slotted aperture 62 of the doctor back 52.

The slotted aperture 62 in the doctor back 52 extends from one side 64 of the doctor back 52. The slotted aperture 62 is in a shape complementary to the shape of the tenon 56. That is, the slotted aperture 62 has an inverted T-shape and forms a mortise 63 into which the tenon 56 is slid into the doctor back 52 substantially as shown by the arrow 66 in FIG. 3. It should be understood that in FIG. 3, the rest of the blade carrier assembly 28 is not shown for simplification of this Figure. However, in practice, the blade carrier assembly 28 has lower base plate 30 slid across supporting surface 54 of the doctor back 52 as the tenon 56 is slid laterally into mortise 63. The mortise 63 is sized to loosely receive the tenon 56. The mortise 63 and tenon 56 both extend along the longitudinal axis 70 (FIG. 3) which is parallel to the axis 14 of the cylindrical surface 12. At this stage in the assembly of the doctoring apparatus 10, the blade carrier assembly 28 is coupled to the doctor back 52 as shown in FIG. 2.

Once the blade carrier assembly 28 is coupled relative to the doctor back 52, the flexible walled tubes 32 are pressurized. This causes the separation of the outer support plate 26 relative to the lower base plate 30 and the shaft 48 pulls the brackets 40, lifting the brackets 40 and the tenon 56 through the threaded engagement of the screw 44 with a threaded aperture in the tenon 56. As a consequence, there is local deflection at 72 (see FIG. 1) of the lower base plate 30. This permits surfaces 74 of the legs 58 of the tenon 56 to engage in interference fit the surfaces 76 of the mortise 63. The blade carrier assembly 28 is now locked to the doctor back 52 for doctoring operation.

The advantage associated with the doctoring apparatus of 10 of the present invention arises that in the event that the blade 16 or blade carrier assembly 28 require maintenance for cleaning or for replacement of parts, the flexible walled tubes 32 are simply de-pressurized and the carrier assembly 28 slid laterally out from the doctor back 52.

It should be understood that the complimentary surfaces 74 of the tenon 56 with the surfaces 76 of the mortise 63 are blackened to permit for less friction during the lateral sliding of the surfaces relative to each other. This, however, does not significantly affect the locking engagement of these surfaces.

Figure 5:
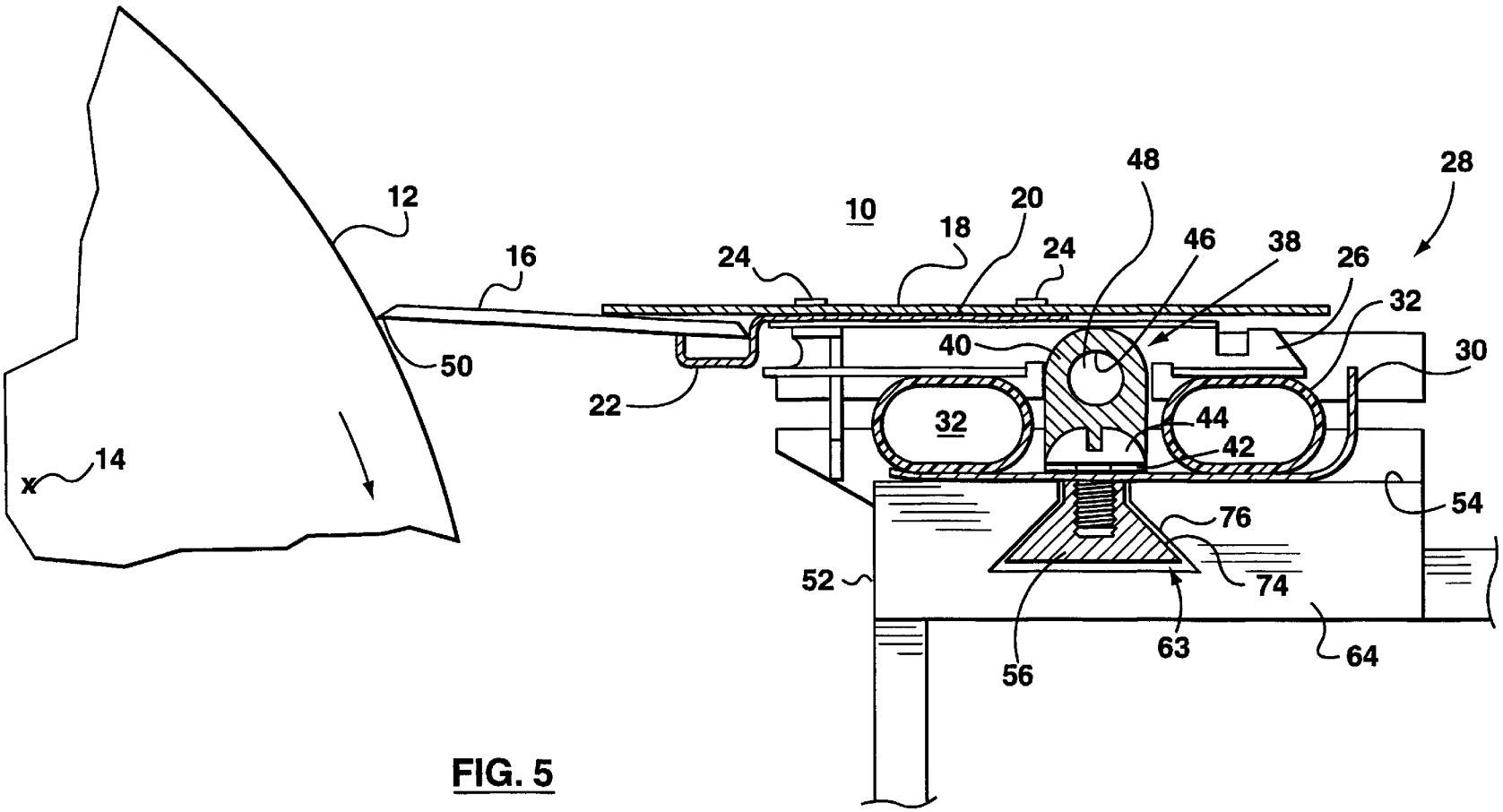

Referring now to FIG. 5 there is shown an alternate embodiment for the tenon 56 and the mortise 63 wherein the mating surfaces 74 and 76 respectfully of the tenon 56 and the mortise 63 are flared surfaces. Alternatively, the tenon 56 may be movable by having its legs 58 move from a contracted position to an expanded diverging position where the mating surfaces of the legs 58 spread into contact with the engaging surfaces of the mortise 63. It should be understood that any design resulting in a coupling associated with a tenon 56 and a mortise 63 may be satisfactory for the function of the present invention. That is, a coupling arrangement that allows the blade carrier assembly 28 to be located relative to the doctor back 52 while simultaneously creating or setting up a locking, coupling engagement of surfaces within either the doctor back 52 or the blade carrier assembly 28 which can be locked into place by an adjustment of blade carrier assembly 28 relative to the doctor back

52 in a direction perpendicular to or offset from the relative lateral extension of the mortise 63.

What is claimed is:

1. A doctoring apparatus for doctoring a cylindrical rotating surface, said apparatus comprising:

a doctor blade for doctoring the cylindrical surface;

a blade carrier assembly for holding the doctor blade, said blade carrier assembly having an outer plate and a base and the blade carrier assembly having at least one tenon supported from the base plate;

a doctor back having a supporting surface over which the base plate of the blade carrier assembly is adapted to slide, the supporting surface having at least one mortise, the mortise being sized to loosely receive the tenon to permit the tenon to slide along the mortise as the blade carrier assembly is slid over the supporting surface to couple the blade carrier assembly with the doctor back; and, an adjustment mechanism carried by the blade carrier for moving the tenon into locking engagement with the mortise to releasably secure the blade carrier assembly to the doctor back, the adjustment mechanism comprising at least one bracket having a bearing secured to the base plate, a pivoting rod secured to the outer plate that is journaled in the bearing of the bracket, and a pair of flexible walled tubes positioned between the spaced apart outer and base plates on either side of the bracket, the tubes being pressurized to further separate the outer and base plates to adjust the relative position of the doctor blade with the cylindrical surface and to pull the bracket away from the supporting surface and cause local deflection of the base plate away from the supporting surface of the doctor back to lock the tenon in engagement with the mortise.

2. The doctoring apparatus of claim 1 wherein the mortise has an elongate slot in the supporting surface and has a rectangular cross-sectional opening below the slot and the supporting surface, and the tenon has a stem extending through the slot for connection with the adjustment mechanism.

3. The doctoring apparatus of claim 2 wherein the tenon has two flanges extending outwardly of the stem for interference fit with the mortise when the stem of the tenon is moved by the adjustment mechanism in a direction out through the slot.

4. The doctoring apparatus of claim 1 wherein the tenon has a stem attached to the adjustment mechanism and two flared surfaces extending from the stem for interference engagement with the mortise when the tenon is moved into locking engagement with the mortise.

5. The doctoring apparatus of claim 1 wherein the cylindrical rotating surface is rotatable about a first axis and the mortise extends along a second axis parallel to the first axis.

6. The doctoring apparatus of claim 1 wherein the doctor back has a first side wall and the mortise extends along the supporting surface inward of the doctor back from the first side wall.

7. The doctoring apparatus of claim 6 wherein the cylindrical rotating surface is rotatable about a first axis and the mortise extends along a second axis parallel to the first axis.

8. The doctoring apparatus of claim 1 wherein further including set screws passing through the blade carrier assembly and into the doctor back to prevent shifting of the blade carrier assembly relative to the doctor back.

* * * * *

UNITED STATES PATENT AND TRADEMARK OFFICE

CERTIFICATE OF CORRECTION

PATENT NO. : 6,202,252, B1
DATED : March 20, 2001
INVENTOR(S) : Harrisson

It is certified that error appears in the above-identified patent and that said Letters Patent is hereby corrected as shown below:

Column 5,
Line 8, after base insert -- plate spaced from the outer plate, the outer plate supporting the doctor blade --.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*